United States Patent [19]

McSweeney et al.

[11] Patent Number: 5,009,345

[45] Date of Patent: Apr. 23, 1991

[54] CHUTE CLOSURE APPARATUS

[75] Inventors: Michael A. McSweeney, Lemont; John F. Stufflebeam, Romeoville, both of Ill.

[73] Assignee: J. I. Case Company, Racine, Wis.

[21] Appl. No.: 419,461

[22] Filed: Oct. 10, 1989

[51] Int. Cl.[5] ..... B65D 47/00

[52] U.S. Cl. ..... 222/556; 222/517; 251/294; 251/301

[58] Field of Search ..... 222/556, 504, 505, 517; 193/3; 251/294, 300, 301, 303, 105, 100

[56] References Cited

U.S. PATENT DOCUMENTS

| | | | |
|---|---|---|---|
| 9,837 | 7/1853 | Camp . | |
| 162,734 | 4/1875 | Ziegel . | |
| 414,725 | 11/1889 | Rose . | |
| 1,105,209 | 7/1914 | Sauchereau | 251/301 |
| 1,368,970 | 2/1921 | Roberts et al. . | |
| 1,746,410 | 2/1930 | Tolman, Jr. . | |
| 1,767,904 | 6/1930 | Stentz . | |
| 1,776,251 | 9/1930 | Donnellan | 222/505 |
| 1,940,081 | 12/1933 | Felies . | |
| 2,648,867 | 8/1953 | Erling . | |
| 2,806,489 | 9/1957 | Armstrong | 251/301 X |
| 3,380,475 | 4/1968 | Armstrong | 251/301 X |
| 3,545,653 | 12/1970 | Blackmore | 222/556 |
| 3,779,428 | 12/1973 | Bauman | 222/498 |
| 3,916,949 | 11/1975 | Armstrong | 251/301 |
| 4,235,415 | 11/1980 | Heckenkamp | 251/294 X |
| 4,548,337 | 10/1985 | Morris | 222/505 X |

*Primary Examiner*—Michael S. Huppert
*Assistant Examiner*—Gregory L. Huson
*Attorney, Agent, or Firm*—Peter N. Jansson, Ltd.

[57] ABSTRACT

An apparatus for closing a chute includes a chute for dispensing a granular material. A gate assembly is mounted for controllably opening and closing the chute and includes a bridge member with a curved gate attached to it. The gate assembly is movable between a first position and a second position. In the first position, the gate permits granular material to be dispensed through the chute and in the second position, the gate co-acts with a sealing member and the chute to prevent material from passing through the chute. In a highly preferred embodiment, the sealing member comprises a plurality of inwardly projecting curved ridges formed on the interior of the chute.

10 Claims, 3 Drawing Sheets

CHUTE CLOSURE APPARATUS

FIELD OF THE INVENTION

This invention relates generally to material dispensers and, more particularly, to an apparatus for controllably closing a chute.

BACKGROUND OF THE INVENTION

Elongate, conduit-like chutes are often used to move granular material, grain seeds for example, from one location to another. Often, such chutes are fed from hoppers containing the granular material and the chutes may be fed by gravity, by pressurizing the hopper or by a combination of these. It frequently becomes necessary to effect closure of the chute during hopper refilling, when the chute and its associated system are being moved to a different location or for other reasons.

In addition, there may be a need to operate the closure apparatus even though the chute may be filled with material. Depending upon the configuration of the system, it may also be necessary to operate the closure apparatus from a remote location.

One approach to the construction of a chute closure apparatus is shown in U.S. Pat. No. 3,779,428. This mechanism uses a gate which moves about a pivot access located generally coincident with a wall of the chute. The gate is arranged to be manually positioned by a grasping handle and when moved in a direction to close the chute, must urge the material contained therein upward against the force of gravity or other motive force. During closure movement, the gate presents a very large surface area to the granular material. Therefore, the force required to move the gate to a closed position may well be high, perhaps so high that closing movement is impossible. In addition to the foregoing, the gate occupies valuable space within the interior of the chute when the gate is lodged in the open position. The maximum flow capacity of the chute is thereby impaired.

Various closure devices are also shown in U.S. Pat. Nos. 3,545,653; 2,648,867; 1,940,081; 414,725; 1,368,970; 1,767,904; 1,746,410; 162,734 and 9837.

Such structures have failed to address the need for a chute closure apparatus which provides excellent sealing closure of the chute, which is readily operable even when the chute is filled with granular material and which may be arranged to be positioned from a remote location. A chute closure apparatus which provides these benefits and which may be readily constructed and installed on a chute would be distinct advance in the art.

OBJECTS OF THE INVENTION

It is an object of this invention to overcome some of the problems and shortcomings of the prior art.

Another object of this invention is to provide a chute closure apparatus which provides excellent sealing closure of a chute when dispensing granular material including grain seeds.

Another object of this invention is to provide a chute closure apparatus which may be readily operated even when the chute is filled with granular material.

Still another object of this invention is to provide a chute closure apparatus which avoids interference with the granular material flowing through the chute when the apparatus is in the open position.

Yet another object of this invention is to provide a chute closure apparatus which may be operated from a remote location.

These and other important objects will be apparent from the description of this invention which follow.

SUMMARY OF THE INVENTION

An apparatus for closing a chute includes a chute for dispensing a granular material. A gate assembly is mounted for controllably opening and closing the chute and includes a bridge member with an arcuate gate attached to it. The gate assembly is movable between a first position and a second position. In the first position, the gate permits granular material to be dispensed through the chute and in the second position, the gate co-acts with a sealing member and the chute to prevent material from passing. In a highly preferred embodiment, the sealing member comprises a plurality of inwardly projecting curved ridges formed on the interior of the chute.

More particularly, the gate assembly includes an elongate bridge member and an elongate arm extending from each end of the bridge member. When so arranged, the bridge member and the arms define a generally U-shaped structure mounted straddle-wise on the exterior of the chute.

Each arm of the gate assembly is attached to the chute by a pivot mount coupled between the arm and the wall structure of the chute. The gate assembly also includes a gate which has a first edge attached to the bridge member, a second edge for engaging the wall structure when the chute is closed and a curved closure panel which extends between the first edge and the second edge. In a highly preferred embodiment, the apparatus will also include a control assembly attached to the gate assembly and operable to open and close the chute from a remote location.

In a highly preferred embodiment, the entirety of the gate is supported at a position which avoids interference with the interior cavity of the chute when the gate assembly is in the open position. The gate is substantially entirely confined within the interior of the chute when it is in the closed position. A slot is formed in the wall structure of the chute and when the gate assembly is moved from the first position toward the second position, i.e., in a direction to close the chute, this causes the gate to be extended through the slot to the interior of the chute. The gate has a radius of curvature which is essentially constant and which has one of its ends coincident with the pivot axis of the pivot mounts. The sealing member likewise has a radius of curvature which is essentially constant and which differs only slightly in length from that of the gate. When so constructed and arranged, the gate and the sealing member co-act for close sealing engagement. When the gate is in the closed position, its second or distal edge engages the wall structure of the chute. Significant leakage and consequent loss of the granular material is thereby prevented.

A control assembly is attached to the gate assembly and is operable to move the gate assembly between the open and the closed positions. The control assembly may include a flexible, sheathed cable with an attached handle for remote, manual operation. In the alternative, the control assembly may include the foregoing together with a hydraulic cylinder for remote, powered operation.

DETAILED DESCRIPTIONS OF PREFERRED EMBODIMENTS

Figure 1:
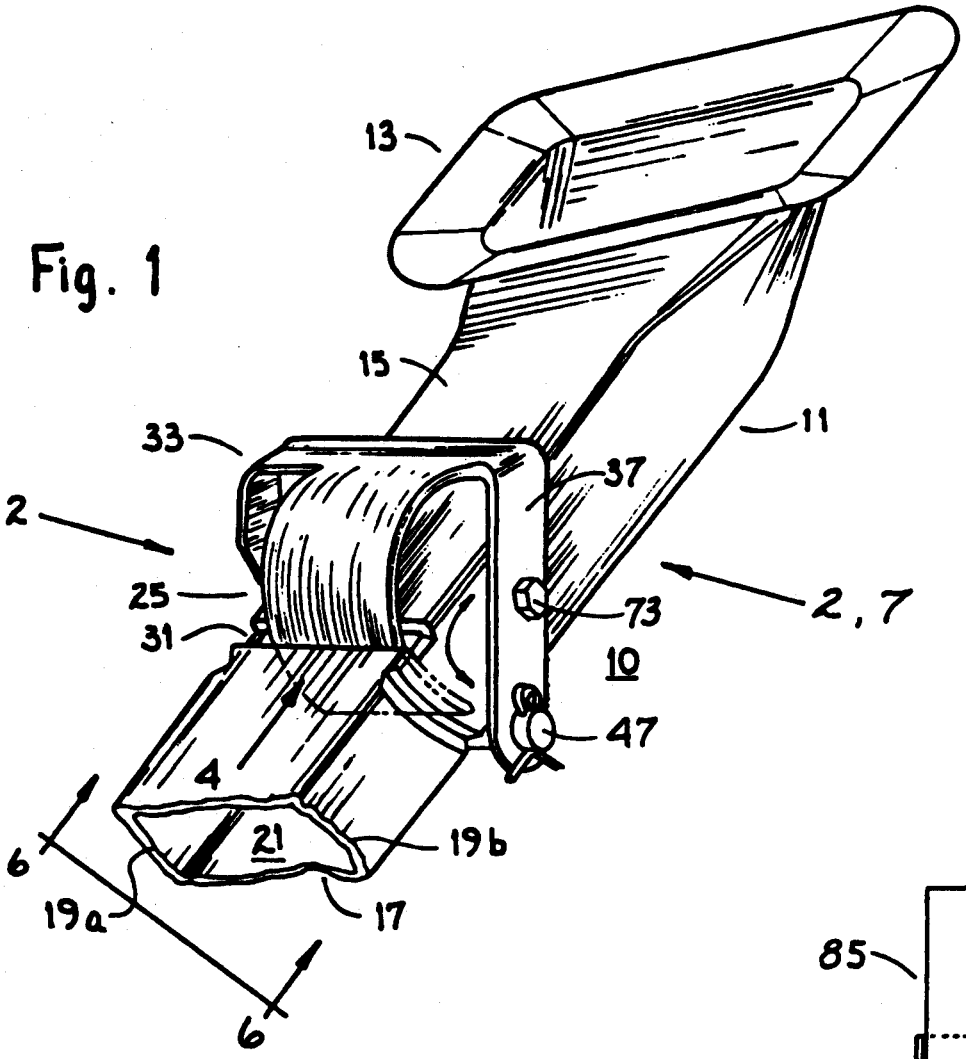
FIG. 1 is a perspective view of the apparatus of the invention.

The figures depict an apparatus 10 for controllably closing a chute.

Solely by way of example and referring to FIGS. 1, 2 and 3, the inventive apparatus 10 will be described in conjunction with a seed conveying chute 11 connected between a seed hopper 13 and a planting mechanism (not shown). The chute 11 is shown to include a top wall 15, a bottom wall 17 and a pair of side walls 19*a*, 19*b*. The walls 15, 17, 19*a*, 19*b* are constructed and arranged so that the chute 11 has a generally rectangular cross section and defines an elongate interior cavity 21.

Figure 2:
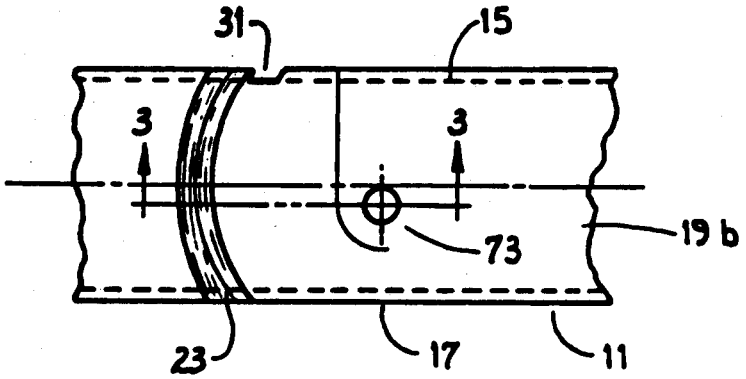
FIG. 2 is a side elevation view of the chute shown in FIG. 1 taken along the viewing axis 2 of FIG. 1, with the gate assembly and certain parts omitted for clarity and other parts shown in dotted outline.
Figure 3:
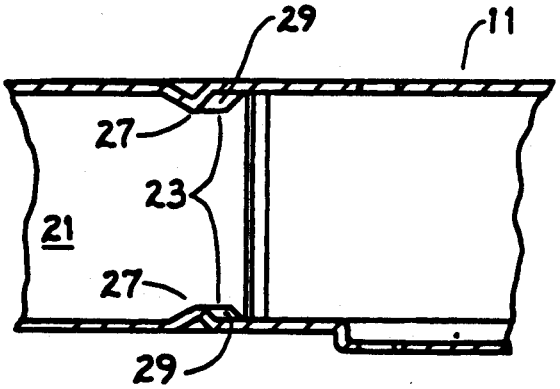
FIG. 3 is a cross-sectional bottom plan view of the chute shown in FIG. 2, taken along the plane 3—3 of FIG. 2.

As best seen in FIGS. 2 and 3, the chute 11 includes a sealing member 23 for co-acting with a gate 25 when the chute 11 is closed. In a highly preferred embodiment, the sealing member 23 is embodied as a plurality of inwardly projecting arcuate ridges 27 shaped by deforming the side walls 19*a*, 19*b* of the chute 11. However, these ridges 27 may be separately fabricated and attached to the interior surface of the side walls 19*a*, 19*b*. Each ridge 27 includes a sealing face 29 which co-acts with the gate 25 to help seal the chute 11 in a manner described in detail below.

Figure 7:
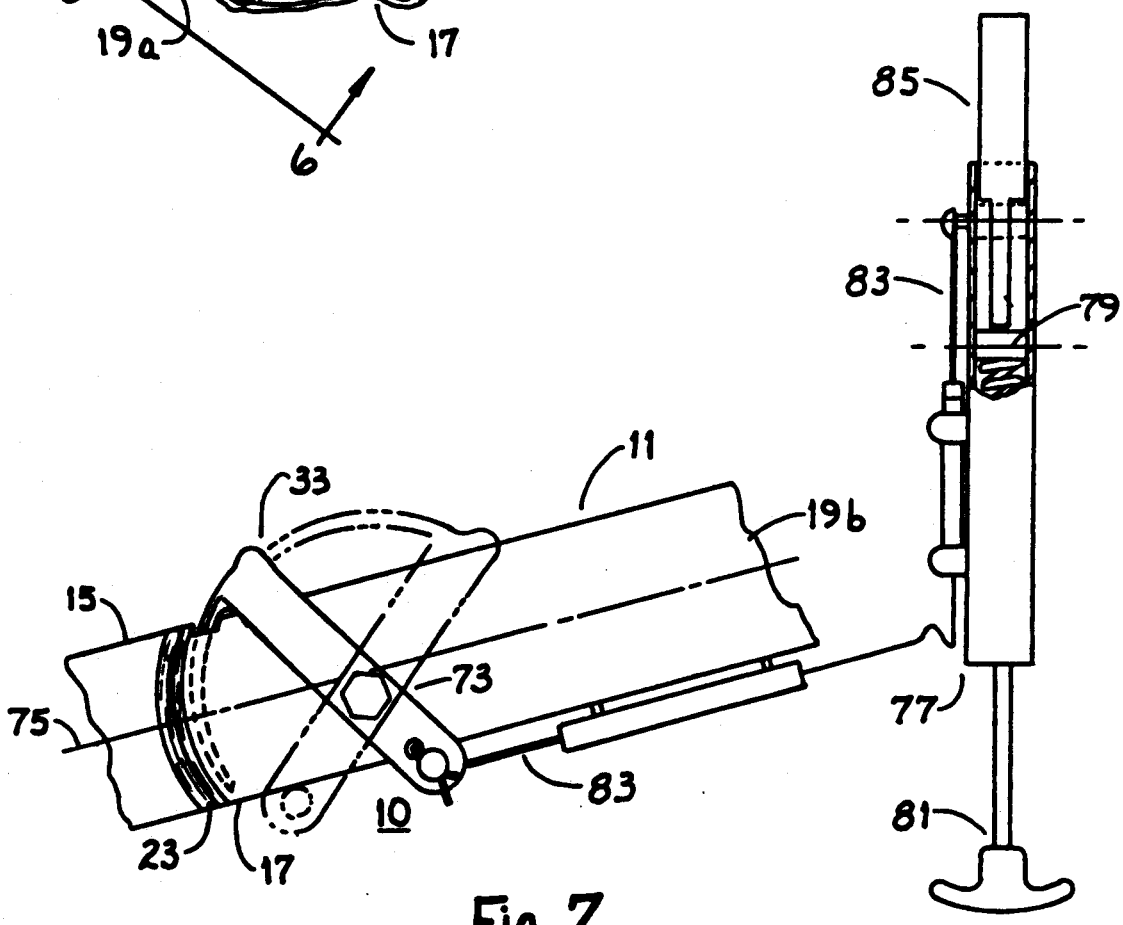
FIG. 7 is a side elevation view of the apparatus of FIG. 1 taken along the viewing axis 7 of FIG. 1, with a control assembly added, with parts broken away and with other parts in dotted outline.

A slot 31 is formed in the top wall 15 of the chute 11 and extends laterally across the width thereof and slightly into the side walls 19*a*, 19*b*. This slot 31 is sized to receive the gate 25 with slight clearance and to permit the gate 25 to extend into the interior cavity 21 as the gate assembly 33 is moved from its first position, as shown in FIG. 1 and in FIG. 7 in dotted outline, toward a second position as shown in FIG. 7 in solid outline.

Figure 4:
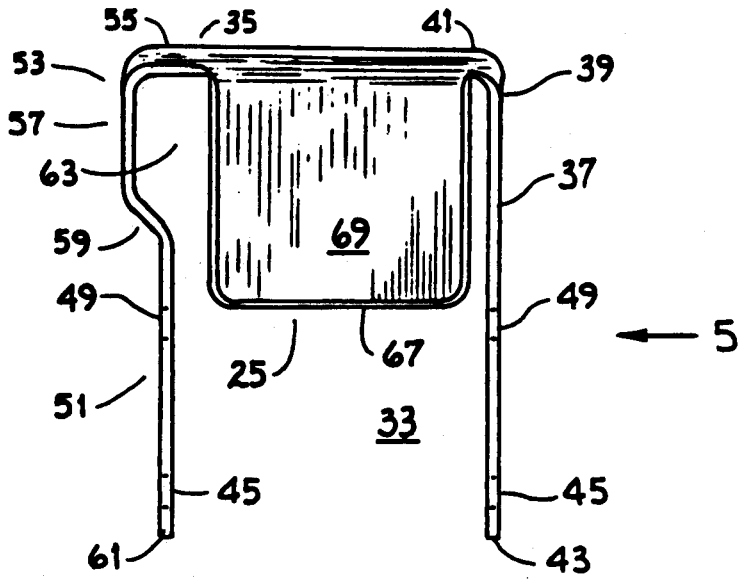
FIG. 4 is a front elevation view of the gate assembly of the apparatus shown in FIG. 1, taken along the viewing axis 4 of FIG. 1.
Figure 5:
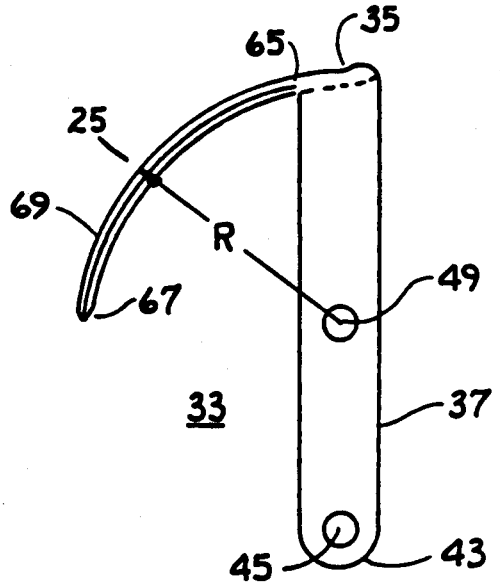
FIG. 5 is a side elevation view of the gate assembly portion of FIG. 4 taken along the viewing axis 5 of FIG. 4.
Figure 6:
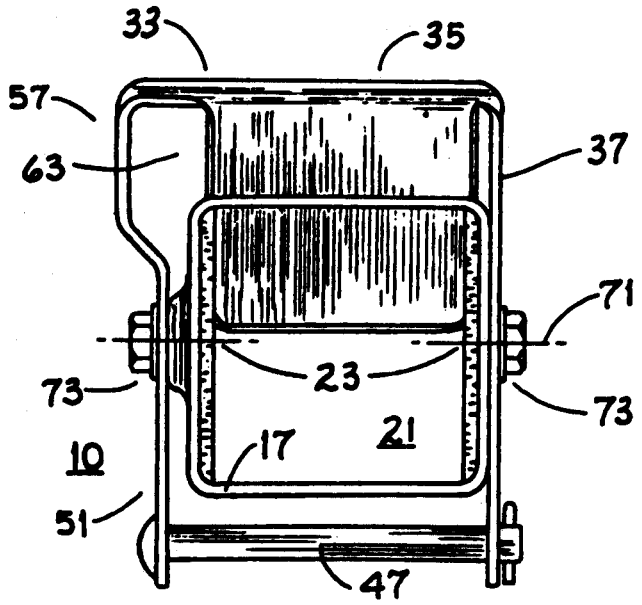
FIG. 6 is a front elevation view of the apparatus of FIG. 1 taken along the plane 6—6 of FIG. 1.

Referring next to FIGS. 4–6, the gate assembly 33 is shown to include an elongate bridge member 35 and a first, elongate arm 37 which has its proximal end 39 attached to an end of the bridge member 35 and its distal end 43 extended therefrom. The first arm 37 has a generally planar bar-like configuration and includes an aperture 45 at its distal end 43 for receiving a linkage pin 47. A pivot hole 49 is formed in the arm 37 at a location generally between the proximal end 39 and the distal end 43 for pivotably mounting the gate assembly 33 upon the chute 11.

A second arm 51 has its proximal end 53 attached to that end 55 of the gate assembly 33 opposite the first arm 37 and includes a protruding shoulder 57, an extension 59 and a distal end 61. In the configuration depicted in FIGS. 4 and 6, there is a space 63 shown between the shoulder 57 and the gate 25. When the gate assembly 33 is in the first or open position, this space 63 accommodates an enlarged flared section (not shown) at the junction of the chute and the hopper. Other chute configurations may dictate arms which have differing shapes without departing from the spirit of the invention.

The second arm 51 also includes a pivot hole 49 for pivotably mounting the assembly 33 to the side wall 19*a* of the chute 11. An aperture 45 is provided near the distal end 61 for receiving the linkage pin 47 and is sized and located to be in registry with the aperture 45 of the first arm 37. The gate assembly 33 thereby provides a first class lever having an input or force-application end at the linkage pin 47, the output end being at the bridge member 35 and the fulcrum being at pivot mounts 73.

The gate assembly 33 also includes an arcuate or curved gate 25 having a first edge 65 attached to the bridge member 35 and a second edge 67 for engaging the bottom wall 17 of the chute when the gate assembly 33 is in the second or closed position. A curved closure panel 69 extends between the first edge 65 and the second edge 67 and has a radius of curvature R which is normal to the pivot axis 71. An end of this radius R is coincident with the pivot axis 71. The points on an arc traversed by the gate 25 during pivoting movement of the gate assembly 33 are at a uniform distance from the pivot axis 71. In a highly preferred embodiment, the gate 25 is rigid and has a sharpened chisel edge formed at the second edge 67.

Referring next to FIGS. 1 and 6, the gate assembly 33 is shown to be attached to the side walls 19*a*, 19*b* of the chute 11 by pivot mounts 73, using the pivot holes 49 for the purpose. As best seen in FIG. 7, mounting is preferably so that the pivot axis 71 is spaced slightly downward from the longitudinal centerline 75 of the side walls 19*a*, 19*b*. A linkage pin 47 connects the distal ends 43, 61 of the arms 37, 51 and at that end of the pin 47 adjacent the first arm 37, the pin 47 provides a convenient connection point for a control assembly 77. The gate assembly 33 is mounted to the chute 11 so that when the gate assembly 3 is moved from the first position to the second position, the gate 25 may extend into the slot 31, with slight perimeter clearance, and its edge 67 may come into contact with the bottom wall 17 of the chute 11. From the foregoing and from an inspection of FIGS. 1 and 7, it will be appreciated that the distance moved by the linkage pin 47 is not greater than the distance moved by the bridge member 35 when such bridge member 35 is moved between the first position and the second position. Mounting in such fashion (with the pivot mounts 73 slightly closer to the distal ends 43, 61) permits a shorter "throw" of the linkage pin 47 as the gate 25 is moved between the open and closed positions. When operated by a remote control assembly 77 as described below, such feature permits such assembly 77 to have a shorter throw and resulting shorter actuating time. Depending upon the geometry of the apparatus 10 and the chute 11 on which it is used, such mounting may also permit the linkage pin 47 to contact the bottom wall 17 at either of two locations and thereby limit or "stop" the travel of the gate assembly 33 in each direction.

Referring to FIGS. 1-3, the inwardly projecting curved ridges 27 are preferably formed on the interior surfaces of the side walls 19*a*, 19 *b*. The ridges 27 are positioned to come to sealing engagement on the downstream side of the gate 25, i.e., that side opposite the hopper 13. The radii of curvature of the ridges 27 will be uniform one to the other and only slightly greater in length than the radius of curvature R of the gate 25. When so fashioned, the sealing faces 29 of the ridges 27 will be in substantially sealing engagement with that portion of the gate 25 extending between the top wall 15 and the bottom wall 17. When the gate assembly 33 is moved to the second position to fully close the gate 25, the edge 67 will be urged through any granular material in the chute 11 and will come to be in substantial sealing engagement with the bottom wall 17.

From the foregoing, it will be understood that when the gate assembly 33 is in the first position, substantially the entirety of the gate 25 is supported at a position exterior of the chute 11. In that position, the second edge 67 of the gate 25 will be generally adjacent the slot 31, thereby freeing the entirety of the interior cavity 21 for the dispensation of granular material. When the gate assembly 3 is in the second position, the gate 25 will be substantially entirely confined within the interior cavity 21 of the chute 11.

Referring next to FIG. 7, the gate assembly 33 may be moved between its first position and its second position by a control assembly 77 which, in one embodiment, includes a spring biased piston 79 coupled to the control handle 81 and to the control cable 83, the latter being coupled to the linkage pin 47. The gate 25 may be opened by drawing the handle 81 downward as viewed in FIG. 7 and latching it against the force of the spring. Gate closure is accomplished by unlatching the handle 81 and permitting the spring to urge the gate assembly 33 to the second position as shown in solid outline.

In the alternative, the control assembly 77 may also include a single acting hydraulic cylinder 85 for opening the gate 25, gate closure likewise being accomplished by spring force. From the foregoing, it will be appreciated that the use of either embodiment of the control assembly 77 will permit the gate assembly 33 to be positioned from a operating location remote from the gate assembly 33 and the chute 11.

As noted above, the apparatus 10 is particularly useful for controllably opening and closing a seed-dispensing chute 11 connected between a seed hopper 13 and a planting mechanism. In larger towed agricultural planting systems, the planting machine structures supporting multiple seed dispensing systems may be extended laterally for planting or folded rearward for transport. This is readily accomplished with the inventive apparatus 10 which well lends itself to remote control.

From the foregoing, it will be appreciated that the apparatus 10 may be modified without departing from the spirit of the invention. As examples, the ridges 27 may be located on the upstream side of the chute 11. Also, the bottom wall 17, the side walls 19*a*, 19*b* and the gate 25 may be conformably shaped with curvature. That is, the side walls 19*a*, 19*b* may be angularly disposed inward toward the bottom wall 17, which itself may be flat or curved. The gate 25 may likewise be conformably shaped to the cross-sectional profile defined by the side walls 19*a*, 19*b* and the bottom wall 17. This arrangement will also effect full closure of the chute 11 when the gate assembly 33 is in the second position.

While the principles of this invention have been described in connection with specific embodiments, it should be understood clearly that these descriptions are made only by way of example and are not intended to limit the scope of the invention.

What is claimed is:

1. An apparatus for controllably closing a seed-dispensing chute connected to a seed hopper, such chute having a pair of side walls, each such side wall having a longitudinal center line, the apparatus including:

a chute;

a gate assembly movable between an open position and a closed position, such gate assembly thereby controllably opening and closing the chute, such gate assembly including a first arm and a second arm depending from a bridge member, each such arm having two ends including a proximal end and a distal end, such distal ends being connected by a linkage pin, each such arm being mounted on the chute for pivoting movement with respect thereto, such mounting being by a pivot mount attached to each arm at a point between such ends and closer to such distal ends, such pivot mounts defining a pivot axis located near to but non-coincident with the longitudinal center lines of the side walls of the chute, such mounting providing a reduced distance of travel of such linkage pin as the gate assembly is moved between open and closed positions.

2. The apparatus of claim 1 wherein the chute has a top wall and a bottom wall and wherein the bridge member is positioned near the top wall and the distal ends of the arms extend below the bottom wall.

3. The apparatus of claim 2 wherein the linkage pin contacts the bottom wall when the gate assembly reaches the open position or the closed position thereby limiting the pivoting travel of the gate assembly.

4. An apparatus for closing a chute including:

a chute for dispensing material, the chute having a sealing member for co-acting with a gate when the chute is closed;

a gate assembly mounted for controllably opening and closing the chute, the gate assembly including a bridge member with a gate attached thereto, the gate assembly further including a first arm and a second arm attached to the bridge member, each such arm being so attached by its proximal end;

the first arm and the second arm each including a distal end extending below the bottom wall of the chute, the gate assembly being mounted by a pivot mount positioned intermediate the proximal end and the distal end of each arm, such gate assembly thereby defining a first class lever;

the bridge member being movable between a first position whereby the gate permits material to be dispensed through the chute and a second position whereby the gate co-acts with the sealing member to prevent material from passing therethrough;

a linkage pin connected between the distal ends of the first arm and the second arm;

a remote control assembly coupled to the linkage pin by a cable for providing pivoting movement of the gate assembly from a remote location.

5. The apparatus of claim 4 wherein when the magnitude of movement of the linkage pin is somewhat less than the magnitude of movement of the bridge member when the apparatus is moved between the first position and the second position.

6. The apparatus of claim 5 wherein the sealing member is embodied as a pair of inwardly projecting ridges, one such ridge being located immediately adjacent each lateral edge of the gate.

7. An apparatus for closing a chute having a bottom wall, such apparatus including:

a chute for dispensing material, the chute having a sealing member for co-acting with a gate when the chute is closed;

a gate assembly mounted for controllably opening and closing the chute, the gate assembly including a bridge member with a gate attached thereto, the gate assembly further including a first arm and a second arm attached to the bridge member, each such arm being so attached by its proximal end, the first arm and the second arm each including a distal end extending below the bottom wall, such distal ends being joined by a linkage pin for limiting motion of the gate assembly, the gate assembly being attached to the chute by a pivot mount positioned intermediate the proximal end and the distal end of each arm, such mounting and such gate assembly thereby defining a first class lever;

the bridge member being movable between a first position whereby the gate permits material to be dispensed through the chute and a second position whereby the gate co-acts with the sealing member to prevent material from passing therethrough.

8. The apparatus of claim 7 wherein movement of the bridge member between the first position and the second position is by the application of force to the linkage pin.

9. The apparatus of claim 8 wherein the distance moved by the linkage pin is not greater than the distance moved by the bridge member when such bridge member is moved between the first position and the second position.

10. The apparatus of claim 9 wherein the chute includes a slot formed in the wall structure and through which the gate extends when the chute is closed, such slot and such gate defining a space therebetween, such space being devoid of a seal.

* * * * *

UNITED STATES PATENT AND TRADEMARK OFFICE

CERTIFICATE OF CORRECTION

PATENT NO. : 5,009,345

DATED : April 23, 1991

INVENTOR(S) : Michael A. McSweeney and John F. Stufflebeam

It is certified that error appears in the above-identified patent and that said Letters Patent is hereby corrected as shown below:

In Column 4, Line 47, "assembly 3" should be --assembly 33--.

In Column 5, Line 24, "assembly 3" should be --assembly 33--.

UNITED STATES PATENT AND TRADEMARK OFFICE

CERTIFICATE OF CORRECTION

PATENT NO. : 5,009,345

DATED : April 23, 1991

INVENTOR(S) : Michael A. McSweeney and John F. Stufflebeam

It is certified that error appears in the above-identified patent and that said Letters Patent is hereby corrected as shown below:

1. An apparatus for closing a chute having a bottom wall, such apparatus including:

-a chute for dispensing material, the chute having a sealing member for co-acting with a gate when the chute is closed;

-a gate assembly mounted for controllably opening and closing the chute, the gate assembly including a bridge member with a gate attached thereto, the gate assembly further including a first arm and a second arm attached to the bridge member, each such arm being so attached by its proximal end, the first arm and the second arm each including a distal end extending below the bottom wall, such distal ends being joined by a linkage pin for limiting motion of the gate assembly, the gate assembly being attached to the chute by a pivot mount positioned intermediate the proximal end and the distal end of each arm, such mounting and such gate assembly thereby defining a first class lever;

-the bridge member being movable between a first position whereby the gate permits material to be dispensed through the chute and a second position whereby the gate co-acts with the sealing member to prevent material from passing therethrough.

2. The apparatus of claim 15 wherein movement of the bridge member between the first position and the second position is by the application of force to the linkage pin.

3. The apparatus of claim 16 wherein the distance moved by the linkage pin is not greater than the distance moved by the bridge member when such bridge member is moved between the first position and the second position.

4. The apparatus of claim 17 wherein the chute includes a slot formed in the wall structure and through which the gate extends when the chute is closed, such slot and such gate defining a space therebetween, such space being devoid of a seal.

UNITED STATES PATENT AND TRADEMARK OFFICE

CERTIFICATE OF CORRECTION

PATENT NO. : 5,009,345

DATED : April 23, 1991

INVENTOR(S) : Michael A. McSweeney and John F. Stufflebeam

It is certified that error appears in the above-identified patent and that said Letters Patent is hereby corrected as shown below:

5. An apparatus for controllably closing a seed-dispensing chute connected to a seed hopper, such chute having a pair of side walls, each such side wall having a longitudinal center line, the apparatus including:

-a chute;

-a gate assembly movable between an open position and a closed position, such gate assembly thereby controllably opening and closing the chute, such gate assembly including a first arm and a second arm depending from a bridge member, each such arm having a proximal end and a distal end, such distal ends being connected by a linkage pin, each such arm being mounted on the chute for pivoting movement with respect thereto, such mounting being by a pivot mount attached to each arm at a point intermediate such ends and closer to such distal ends, such pivot mounts defining a pivot axis located adjacent to but non-coincident with the longitudinal center lines of the side walls of the chute, such mounting providing a reduced distance of travel of such linkage pin as the gate assembly is moved between open and closed positions.

6. The apparatus of claim 19 wherein the chute has a top wall and a bottom wall and wherein the bridge member is positioned near the top wall and the distal ends of the arms extend below the bottom wall.

7. The apparatus of claim 20 wherein the linkage pin contacts the bottom wall when the gate assembly reaches the open position or the closed position thereby limiting the pivoting travel of the gate assembly.

UNITED STATES PATENT AND TRADEMARK OFFICE

CERTIFICATE OF CORRECTION

PATENT NO. : 5,009,345

DATED : April 23, 1991

INVENTOR(S) : Michael A. McSweeney and John F. Stufflebeam

It is certified that error appears in the above-identified patent and that said Letters Patent is hereby corrected as shown below:

8. An apparatus for closing a chute including:

-a chute for dispensing material, the chute having a sealing member for co-acting with a gate when the chute is closed;

-a gate assembly mounted for controllably opening and closing the chute, the gate assembly including a bridge member with a gate attached thereto, the gate assembly further including a first arm and a second arm attached to the bridge member, each such arm being so attached by its proximal end;

-the first arm and the second arm each including a distal end extending below the bottom wall of the chute, the gate assembly being mounted by a pivot mount positioned intermediate the proximal end and the distal end of each arm, such gate assembly thereby defining a first class lever;

-the bridge member being movable between a first position whereby the gate permits material to be dispensed through the chute and a second position whereby the gate co-acts with the sealing member to prevent material from passing therethrough;

UNITED STATES PATENT AND TRADEMARK OFFICE

CERTIFICATE OF CORRECTION

PATENT NO. : 5,009,345 Page 5 of 5

DATED : April 23, 1991

INVENTOR(S) : Michael A. McSweeney and John F. Stufflebeam

It is certified that error appears in the above-identified patent and that said Letters Patent is hereby corrected as shown below:

-a linkage pin connected between the proximal ends of the first arm and the second arm;

-a remote control assembly coupled to the linkage pin by a cable for providing pivoting movement of the gate assembly from a remote location.

9. The apparatus of claim 22 wherein when the magnitude of movement of the linkage pin is somewhat less than the magnitude of movement of the bridge member when the apparatus is moved between the first position and the second position.

10. The apparatus of claim 23 wherein the sealing member is embodied as a pair of inwardly projecting ridges, one such ridge being located immediately adjacent each lateral edge of the gate.

Signed and Sealed this

First Day of September, 1992

*Attest:*

DOUGLAS B. COMER

*Attesting Officer*

*Acting Commissioner of Patents and Trademarks*